United States Patent [19]

Searight et al.

[11] 4,108,242

[45] Aug. 22, 1978

[54] JET IMPINGEMENT HEAT EXCHANGER

[75] Inventors: Edward F. Searight, Harvard; Paul Flanagan, Lexington, both of Mass.

[73] Assignee: Thermo Electron Corporation, Waltham, Mass.

[21] Appl. No.: 330,348

[22] Filed: Feb. 7, 1973

Related U.S. Application Data

[63] Continuation-in-part of Ser. No. 165,568, Jul. 23, 1971, abandoned.

[51] Int. Cl.[2] ..... F28F 13/12

[52] U.S. Cl. ..... 165/164; 34/160; 165/DIG. 11

[58] Field of Search ..... 165/1, 109, 165, 164; 34/20, 155, 156, 160

[56] References Cited

U.S. PATENT DOCUMENTS

| | | | |
|---|---|---|---|
| 2,591,621 | 4/1952 | Shegda | 34/160 X |
| 2,594,299 | 4/1952 | Dungler | 34/160 |
| 3,034,769 | 5/1962 | Bertin et al. | 165/1 X |
| 3,109,485 | 11/1963 | Fortier | 165/1 |
| 3,416,011 | 12/1968 | Lyczko | 165/109 X |

OTHER PUBLICATIONS

Kercher et al., DM *Heat Transfer by a Square Array of Round Air Jets . . . ,* ASME Paper No. 69-GT-4, Gas Turbine Conference and Products Show, Cleveland, Ohio, Mar. 1969.

*Primary Examiner*—Albert W. Davis, Jr.
*Attorney, Agent, or Firm*—James L. Neal

[57] ABSTRACT

A heat exchanger for directing discrete jets of fluid against a heat exchanging wall is configured to establish relatively close spacing between the openings through which the jets are formed and a portion of the heat exchanging wall while providing relatively large volumes of space adjacent other portions of the heat exchanging wall. The large volumes of space permit passage of the fluid from adjacent the heat exchanging wall without disturbing the jet flow.

4 Claims, 7 Drawing Figures

JET IMPINGEMENT HEAT EXCHANGER

CROSS REFERENCE TO THE RELATED APPLICATION

This application is a continuation-in-part of patent application, Ser. No. 165,568, filed July 23, 1971 now abandoned, having the identical title and inventors as the present application, now abandoned.

BRIEF SUMMARY OF THE INVENTION

This invention involves apparatus for effectively transferring heat between a heat exchanging wall and a fluid. The fluid is directed through openings under pressure to form jets which forcibly impinge upon the heat exchanging wall. The impingement of the fluid jet against the heat exchanging wall produces efficient transfer of heat. Most favorable conditions exist when a relatively large number of relatively small jets are used and when the jets are positioned close to the heat exchanging wall. To be effective, each jet must operate substantially independently of the other jets. This independent operation, however, tends to be impaired by the collection of fluid adjacent the heat exchanging wall and the resulting flow of such fluid along the wall. This flow is in a direction which is not parallel to the jets and tends to deflect or entirely disrupt the jets. According to this invention, the means forming the openings through which a fluid is directed onto the heat exchanging wall and the heat exchanging wall itself are configured to establish constrictions wherein there is close spacing between the openings through which the jets are formed and a portion of the heat exchanging wall and to provide enlarged volumes of space adjacent the constrictions. The close spacing of the openings to the heat exchanging wall permits the formation of relatively high velocity jets and the enlarged volumes of space permit flow of fluid from the constricted areas and from the heat exchanging plate at a relatively low velocity so that there is minimized or negligible interference with the flow of individual jets.

DETAILED DESCRIPTION OF THE DRAWINGS

Figure 1:
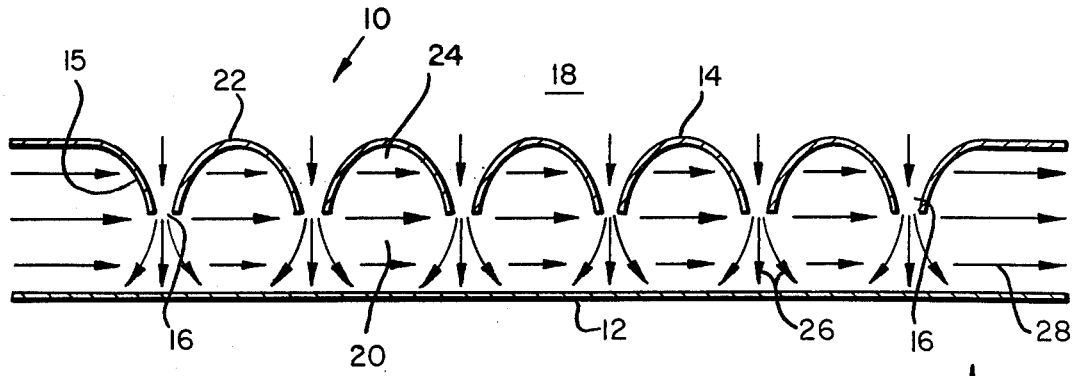
FIG. 1 illustrates one embodiment of the invention.

In FIG. 1, the heat exchanger 10 comprises a heat exchanging plate 12 and a second plate 14 forming a number of nozzles 15 having openings 16 therein. The openings 16 may be circular, elongated slots or of other appropriate configuration. In most embodiments, circular orifices are preferred. The plate 14 is characterized by portions 22 between the openings 16 which diverge sharply away from the plate 12 to form increased volumes of space 24 between the plates 12 and 14. The plate 14 forms a plenum chamber 18 in which fluid is retained at a pressure higher than pressure in the space 20 between the plates 12 and 14. Fluid from the plenum chamber 18 is directed toward the heat exchanging plate 12 through the openings 16 as a plurality of individual jets, a jet being formed by each of the openings 16. As the fluid strikes and moves along the heat exchanging plate 12, the desired heat exchange is effected. After impingement of the fluid jet against the heat exchanging plate 12, the fluid passes along the space between the plates 12 and 14 to an eventual disposition.

Flow of the fluid from between the plates is in a direction generally parallel to the plane of the heat exchanging plate 12 and therefore, in the embodiment of FIG. 1, generally perpendicular to the path of the jets. This flow is indicated by the arrows 28. Flow of fluid in the general direction indicated by the arrows 28 tends to disrupt the jets which flow in the general direction indicated by the arrows 26. This tendency, however, is substantially reduced or eliminated by the increased volumes 24 between the plates 12 and 14. The increased volumes 24 permit a low velocity passage of fluid from the heat exchanging plate 12, in the direction of the arrows 28, which does not tend to disrupt the relatively high velocity jets.

Figure 4:
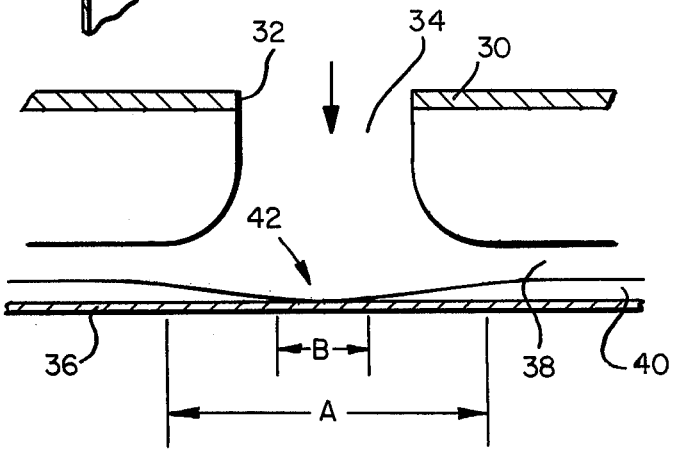
FIG. 4 is a detailed view of a single jet.

Conditions believed to exist along the surface of the plate 12 will now be explained in connection with FIG. 4. When fluid is flowing along a plate, there develops a boundary layer at the surface of the plate which acts as a thermal insulator and inhibits heat transfer across the plate. Effective and efficient heat transfer is accomplished under conditions which interrupt this boundary layer. When fluid from a jet impinges upon the plate, the boundary layer is interrupted and a zone of highly efficient heat transfer is established. For example, a plate 30 forms an orifice 32 through which fluid under pressure is directed to form a jet 34 which impinges upon a heat exchanging plate 36. Fluid from the jet then flows along the plate as indicated at 38 and there develops along the plate 36 a boundary layer 40 of the type described above. However, in the area of impingement of the jet 34 against the plate 36, the boundary layer is interrupted in a manner indicated generally by the numeral 42. There is a centrallized zone, designated A, wherein the boundary layer is effectively interrupted. There is a smaller area, designated B, within the area designated A, in which the boundary layer is most effectively disturbed and in which heat transfer at the heat exchanging plate 36 is maximized. These areas are not well defined and finite, but are indicative of a relatively small area of maximum interruption of the boundary layer surrounded by a transition zone wherein transition from maximum interruption to boundary layer conditions takes place.

It is preferred to have as many jets as possible, within limits, so as to provide as many interruptions of the boundary layer as possible. Sizes and dimensions do not appear to be critical for effective improvement in heat transfer but, within the parameters described below, improvement is optimized. For various conditions and circumstances, the design may be individually varied and adapted. However, a favorable situation develops when the ratio ($x/d$) of the distance ($x$) separating the opening from the heat exchanging plate to the minimum width ($d$) across the opening is not substantially in excess of three. A ratio of two has yielded good results. The optimum condition appears to occur when the opening through which the jet is formed is spaced from the heat exchanging plate by a distance substantially equal to its width. Additional optimization has been found to occur when the total area of the openings equals from 2.5 to 12.5 percent of the total plate face area. Within these parameters laminar flow through the openings provides excellent heat transfer characteristics.

In view of the preference for a large number of relatively small jet forming openings relatively close to the heat exchanging plate which operate independently of each other, effective discharge of fluid from adjacent the heat exchanging plate is a primary factor upon which the effectiveness of the system depends. Accordingly, the apparatus discussed above in connection with FIG. 1 as well as other apparatus of this invention, certain embodiments of which will be discussed below, are configured to locate a large number of relatively small jets very close to the heat exchanging plate while providing enlarged volumes of spaces adjacent the areas in which the jets are formed. The volumes of space permit fluid to pass from the zones of the heat exchanging plate onto which the jets impinge and from the heat exchanging plate without disturbing the jets.

Figure 2:
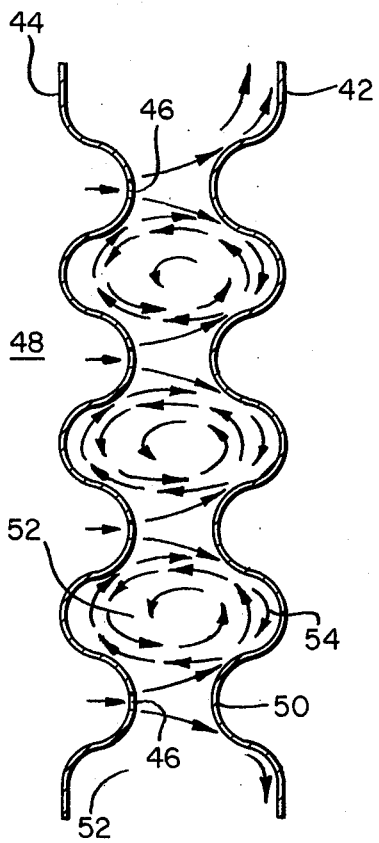
FIG. 2 illustrates a further embodiment of the invention.
Figure 3:
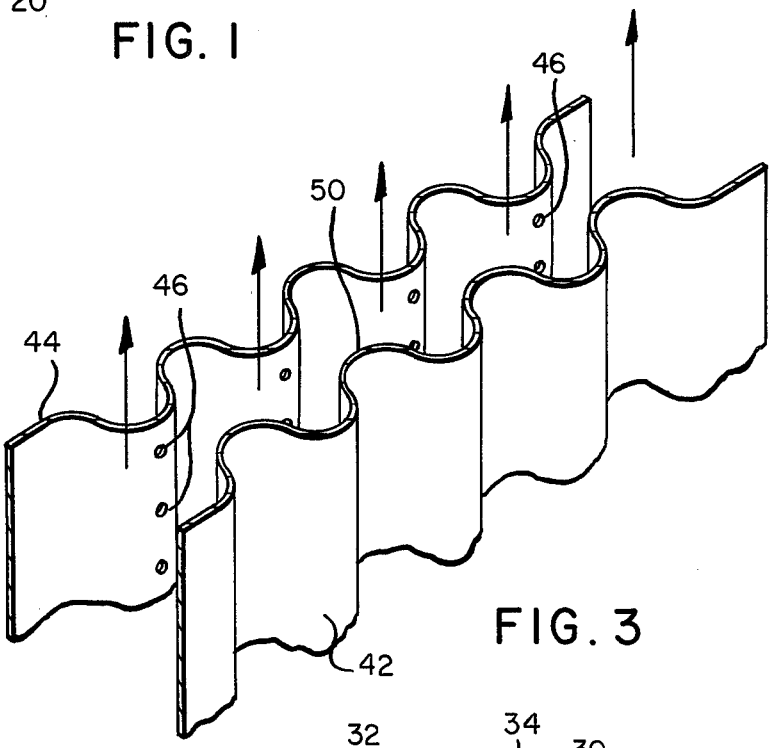
FIG. 3 is a perspective view of the apparatus shown in FIG. 2.

FIGS. 2 and 3 illustrate, respectively, cross-sectional and perspective views of another embodiment of the invention. Two substantially rigid plates of corrugated configuration are situated adjacent each other so that alternating corrugations form a series of relatively narrow constrictions separated by relatively large volumes of space. A heat exchanging plate 42 faces a plate 44. The plate 44 forms orifices 46 along the corrugations which extend toward the heat exchanging plate 42. Both plates are otherwise imperforate. The heat exchanging 42 forms crests 50 which extend toward the orifices 46. Elongated constrictions along which rows of orifices are formed are thereby separated by enlarged passageways 52. A plenum chamber 48 formed along one side of the plate 44 contains fluid under pressure which is directed in the form of jets through the orifices 46 and which impinges upon the crests 50. The fluid then circulates within the enlarged openings 42 in a somewhat circulatory motion which can be characterized as a spin, as illustrated by the arrows of FIG. 2. This spinning motion of the fluid further enhances heat transfer between the fluid and the heat exchanging plate 42. The enlarged passageways 52 also provide a preferred path within which fluid may pass from between the plates 42 and 44 with relatively little interference to the individual jets.

Deformations in the heat exchanging plate, such as corrugations, increase the surface area of the plate and thereby further enhance its heat transfer capability as compared to a relatively flat plate. Accordingly, the embodiment illustrated in FIGS. 2 and 3 provides particularly effective heat transfer since it combines jet impingement heat transfer with an enlarged area over which heat transfer can take place.

Corrugations shown are of undulatory configuration, but any configuration defining a series of points and ridges may be used. For example, the corrugations may involve angular configurations and, within a single plate, the corrugations may be of various configurations and sizes. It will, of course, be apparent that heat exchanging plates covering an extensive area will require the parts of the heat exchanger to be figured so as to form passages 52 which are relatively large as compared to the sizes of the passages 52 which would be required for a heat exchanging plate 42 of relatively limited spatial extent.

Corrugations of all configurations have the advantage of providing rigidity to the plates 42 and 44 so that the plates resist changes in shape and maintain the required spacing between the orifices 46 and the target area along the crests 50.

Figure 5:
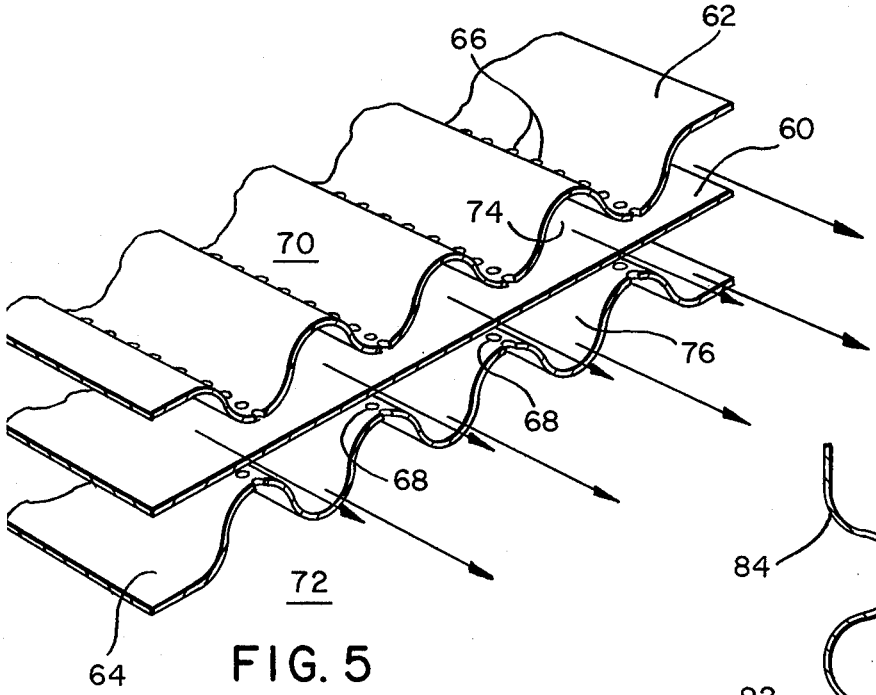
FIG. 5 shows an alternate embodiment of the invention.

FIG. 5 illustrates an alternate embodiment wherein heat exchange takes place along both sides of a heat exchanging plate 60. A pair of plates 62 and 64 are situated along opposite sides of the heat exchanging plate 60 and form corrugations which alternately extend into close and remote proximity to the heat exchanging plate 60. Orifices 66 are formed along the corrugations in close proximity to the heat exchanging plate. The plates 62 and 64 form plenum chambers 70 and 72, respectively. Fluid under pressure is directed from the plenum chambers through the orifices and impinges upon the heat exchanging plate 60. Enlarged passages 74 and 76 formed by the remote corrugations in the plates 62 and 64 provide space into which the fluid may pass after impingement upon the plate 60 and along which the fluid may travel to be discharged from between the plate 60 and the plates 62 and 64.

This embodiment is particularly effective for transferring heat between two fluids. For example, if a relatively hot fluid is confined within the plenum chamber 70 and a relatively cool fluid is confined within the plenum chamber 72, heat exchange will take place between the two fluids across the heat exchanging plate 60. Fluid from the plenum chamber 70 is directed through the orifices 66 and onto the plate 60. Fluid from the plenum chamber 72 is directed through the orifices 68 and onto a portion of the heat exchanging plate 60 which is directly opposite the portion of heat exchanging plate onto which the jets from the orifices 66 are directed. This configuration has the advantage of placing the zones of most effective heat transfer directly opposite each other.

Figure 6:
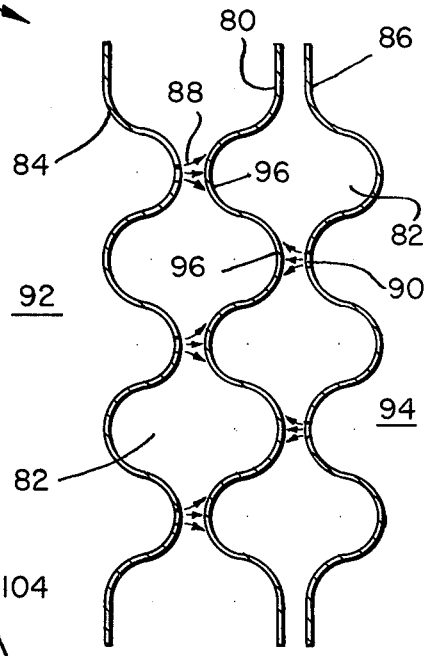
FIG. 6 illustrates another alternate embodiment of the invention.

The embodiment illustrated in FIG. 6 is similar to that illustrated in FIG. 5 except the heat exchanging plate 80 is also corrugated to provide larger passages 82 for discharge of fluid. The plates 84 and 86 and orifices 88 and 90, respectively, direct jets of fluid from their respective plenum chambers 92 and 94 onto alternating crests 96 of the heat exchanging plate 80. The plates 84 and 86 could be planar rather than corrugated, then the embodiments of FIG. 6 would be the substantial equivalent of embodiments shown in FIG. 5, except the corrugated plate would present relatively large surface area over which heat exchange could take place, but the zones of most effective heat transfer would not be established directly opposite each other.

Figure 7:
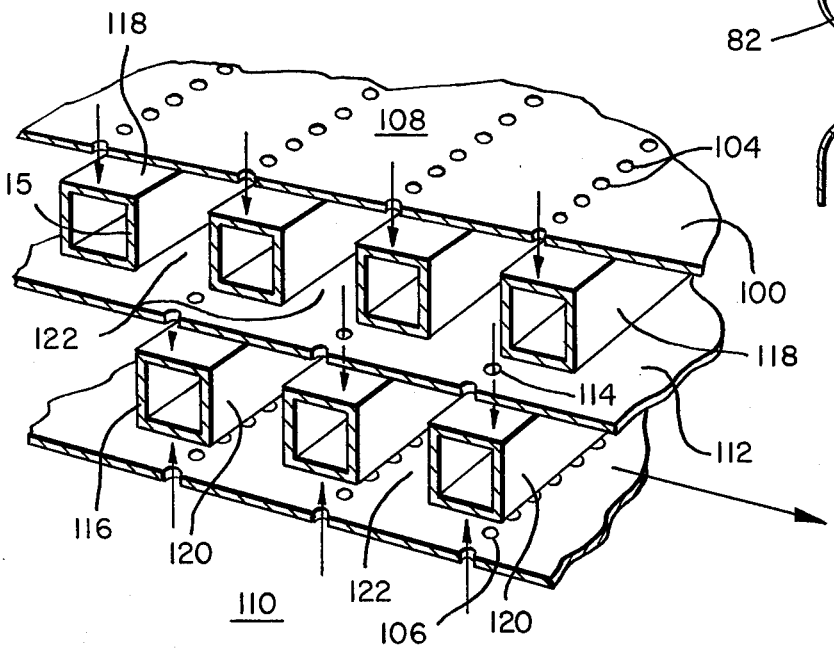
FIG. 7 illustrates still another embodiment of the invention.

A further embodiment of the invention is illustrated by FIG. 7. Plates 100 and 102 each form therein rows of orifices 104 and 106 and confine fluid within plenum chambers 108 and 110, respectively. Between the plates 100 and 102 is a third plate 112 forming orifices 114, in rows. Between the plates 100 and 112 is means forming a series of conduits 115 which confine a fluid. Another series of conduits 116 is established between the plates 102 and 112, the conduits 115 and 116 being staggered. The conduits are separated by spaces 122 and provide, respectively, along their outer surfaces heat exchange means 118 and heat exchange surface means 120. The configuration of FIG. 7 can accommodate as many as four different fluids, with heat exchange taking place at surface means 118 and surface means 120. For example, a first fluid within the plenum chamber 108 may be directed through the orifices 114 onto the heat exchange surface means 118 formed by the conduits 115 which contain a second fluid. The conduits 115 are so configured that they diverge away from the plate 100 for permitting the fluid to pass quickly from the heat exchanging surface means 118. The space 112 between the conduits 115 also provides passage for fluid to the orifices 114 in the plate 112. The fluid is then directed through the orifices 114 onto the heat exchanging surface means 120 formed by the conduit 116, which contains a third fluid. A fourth fluid within the plenum chamber 110 is simultaneously directed through orifices 106 in the plate 102, onto the heat exchanging surface means 120. The conduits 116 are configured so that the heat exchanging surface means 120 diverges away from both plates 102 and 112 and provides an open area between the conduits for the passage from between the plates 102 and 112 of the first and fourth fluids, now intermixed.

The present invention has been described in reference to various preferred embodiments. It should be understood, however, that modifications may be made by those skilled in the art without departing from the scope of the invention.

We claim:

1. A heat exchanger comprising:

(a) a rigid, corrugated, imperforate plate forming a heat exchanging wall; and (b) a second rigid plate fixedly mounted relative to said imperforate plate, forming a second wall spaced from and confronting said heat exchanging wall and forming a plenum chamber along the side thereof opposite said heat exchanging wall for confining fluid under a pressure exceeding the pressure between said heat exchanging wall and said second wall, said second wall forming a plurality of openings in substantially parallel rows for directing jets of said fluid against said heat exchanging wall and otherwise being imperforate, said openings in rows being aligned opposite the portions of the corrugations in said heat exchanging wall where the gap between walls is minimum and spaced from said portions of the corrugations for establishing a ratio ($x/d$) of the distance ($x$) separating an opening from said heat exchanging wall to the minimum width ($d$) of the opening not substantially in excess of three, said heat exchanging wall extending away from said second wall intermediate said rows of openings for establishing a relatively large space between said walls intermediate said rows of openings to permit passage of said fluid from adjacent said heat exchanging wall with a minimized interference to said jets of said fluid.

2. A heat exchanger according to claim 1 wherein said second wall is corrugated.

3. A heat exchanger comprising:

(a) a rigid, corrugated imperforate heat exchanging wall;

(b) a second rigid wall fixedly mounted relative to said heat exchanging wall, spaced from and extending along one side of said heat exchanging wall and forming a first plenum chamber along the side thereof opposite said heat exchanging wall for confining fluid under a pressure exceeding the pressure between said heat exchanging wall and said second wall;

(c) a third rigid wall fixedly mounted relative to said heat exchanging wall, spaced from and extending along the side of said heat exchanging wall opposite said second wall and forming a second plenum chamber along the side thereof opposite said heat exchanging wall for confining fluid under a pressure exceeding the pressure between said heat exchanging wall and said third wall; and (d) means forming a plurality of parallel rows of openings in each of said second and third walls for directing jets of fluid against said heat exchanging wall, said second and third walls otherwise being imperforate, each row of openings in each plate being aligned opposite the proximate corrugated ridge of said heat exchanging wall for establishing a ratio ($x/d$) of the distance ($x$) separating an opening from said heat exchanging wall to the minimum width ($d$) of the opening not substantially in excess of three.

4. A heat exchanger according to claim 3 wherein said second and third walls are corrugated.

* * * * *